United States Patent [19]

Baughman

[11] Patent Number: 4,730,405

[45] Date of Patent: Mar. 15, 1988

[54] DISPLAY STAND

[76] Inventor: Daniel G. Baughman, P.O. Box 541, Darien, Wis. 53114

[21] Appl. No.: 459,329

[22] Filed: Jan. 20, 1983

[51] Int. Cl.[4] ..... G09F 7/02

[52] U.S. Cl. ..... 40/611; 211/4; 206/565; 206/45.14

[58] Field of Search ... 40/611; 211/4, 13, 60 R-60 T, 211/70, 163; 248/131; D6/188, 186; 206/565, 564, 45.12, 45.13, 45.14, 45.15, 562, 563, 566

[56] References Cited

U.S. PATENT DOCUMENTS

| | | | |
|---|---|---|---|
| 770,756 | 9/1904 | Hynek | 211/4 |
| 2,321,339 | 6/1943 | Wadsworth | 211/4 |
| 3,204,774 | 9/1965 | Barbieri | 211/4 |
| 3,243,047 | 3/1966 | Witteborg | 211/163 |
| 3,400,812 | 9/1968 | Snow | 206/565 |
| 3,964,003 | 6/1976 | Sandler | 211/4 |
| 4,300,674 | 11/1981 | Davet | 211/4 |

FOREIGN PATENT DOCUMENTS

| | | | |
|---|---|---|---|
| 857784 | 9/1940 | France | 211/4 |

*Primary Examiner*—Robert Peshock
*Assistant Examiner*—J. Hakomaki
*Attorney, Agent, or Firm*—John C. Cooper, III; Fred Wiviott

[57] ABSTRACT

A display stand for belt buckles or other articles includes an upright stand having one or more vertical display surfaces. A vertical slot is provided in the display which is adapted to receive the buckle clip of a belt buckle or a projection on any other type of article to be displayed. The display also includes a plurality of holes which extend from the display surface at an angle so that they pass through the slot. A plurality of elongate pins are provided to be inserted through the holes and the slot. An article is displayed by inserting its clip or projection into the slot and inserting a pin in the hole to secure the buckle or other article to the stand.

15 Claims, 4 Drawing Figures

DISPLAY STAND

BACKGROUND OF THE INVENTION

1. Field of the Invention

The present invention relates generally to the art of displays, and more particularly to displays for belt buckles or other articles which include a rear projection having an opening therethrough.

2. Description of the Prior Art

While a large number of displays and display stands are known to the art, none are entirely suited for the display of belt buckles or other articles which have a projection on the rear side. The deficiencies of the prior art may be illustrated by reference to the display of belt buckles, but it should be appreciated at the outset that the present invention is not limited thereto. After the present invention is described, one skilled in the art could readily adapt its principles to the display of other articles. Also, after reading the present specification, one skilled in the art could readily determine which types of articles can be displayed using the invention.

Belt buckles have become popular fashion accessories in recent years, and the display and sale of buckles has become an increasingly important line for many retailers. Most buckles include a decorative front face. Such belt buckles are becoming quite elaborate, and many individuals now collect buckles. With the increased popularity of such buckles has come a trend to more expensive buckles and, unfortunately, an increased frequency of shoplifting.

It has also become popular in recent years to include graphics, artwork or written information on the back of belt buckles and the purchasers, whether they be collectors or casual buyers, frequently are as interested in the rear surface of the buckles as they are in the face.

The belt buckles used to illustrate the present invention include a generally planar face. The buckles may be rectangular, square, round or may be prepared in the shape of an article such as an automobile, leaf, a human figure, an animal, etc. Such buckles include a belt clip attached to the rear face which is adapted to be snapped onto a belt. The clip is typically a wireform which lies in a vertical plane and which rotates about a vertical axis. A pin is also typically located on the rear of the face and is adapted to engage a hole in the belt after the belt is wrapped around the wearer.

The display of such buckles in the past has been accomplished in a wide variety of ways. The buckles may be shown in a glass display case or may be arranged in trays for inspection by the potential customer. The examination of the buckles by the customer typically required assistance from the retailer. The buckles are typically picked up and examined. The latter increases the chance for tneft. Moreover, prior art displays do not allow the customers to examine both sides of the buckles. A display for belt buckles or other articles overcoming the problems of the prior art would be a significant advance in the display art.

OBJECTS AND SUMMARY OF THE INVENTION

It is a primary object of the present invention to provide a display which overcomes the above-noted disadvantages of the prior art.

Another object of the present invention is to provide a display which permits both sides of the article being displayed to be viewed by a prospective customer.

A further object of the present invention is to provide a display which may be constructed in a wide variety of shapes and sizes and which may be used to display a variety of articles.

A still further object of the present invention is to provide a display with increased security and which reduces the opportunity for the displayed articles to be removed by shoplifters.

How these and further objects of the invention are accomplished will be described in the following specification, taken in conjunction with the drawings. Generally, however, the objects are accomplished by providing a display having one or more display surfaces and which includes at least one elongate slot in the display surface. A plurality of holes are drilled in the display, the holes beginning adjacent the slot and being angled so they intersect the slot and continue for at least some distance on the opposite side thereof. An object to be secured to the display should have a component which is capable of being inserted in the slot and the component should have an opening therethrough which is at least as large as the diameter of the aforementioned holes. After insertion of the component in the slot, a pin is inserted in the hole and pushed inwardly to pass through the slot and opening and further into the display to secure the article in position. The invention may be variously embodied as will become more apparent from reading the following detailed description of the preferred embodiment.

DESCRIPTION OF THE PREFERRED EMBODIMENT

Figure 1:
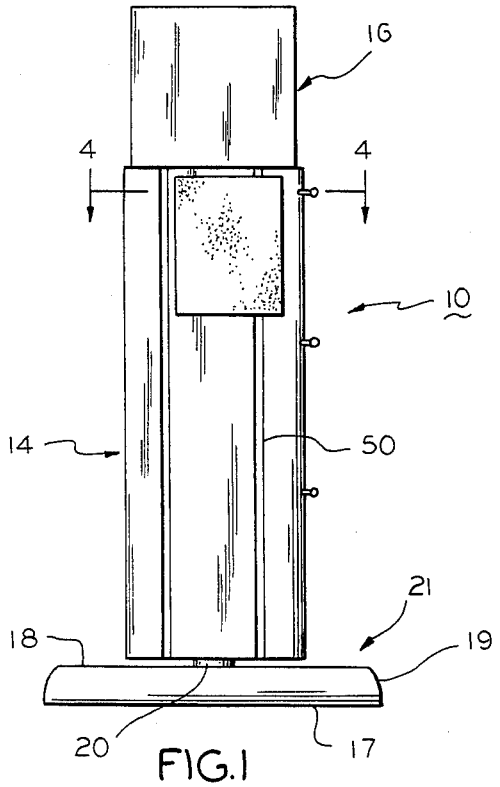
FIG. 1 is a front elevation view of the display stand of the preferred embodiment of the present invention.

FIG. 1 illustrates a display stand 10 according to the preferred embodiment of the present invention to include a base 12, a display member 14 and an informational panel 16. The components may be prepared from a variety of materials including wood, metal, plastics, etc., but for purposes of the description of the preferred embodiment, the components are prepared from wood.

Figure 3:
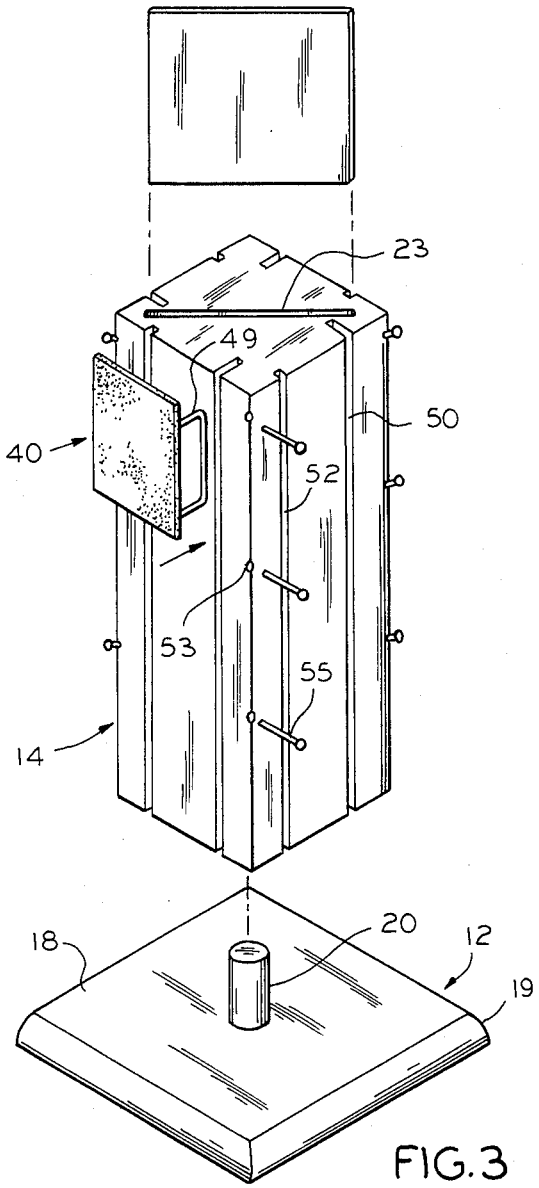
FIG. 3 is an exploded perspective showing the components of the display stand according to the preferred embodiment of the present invention.
Figure 2:
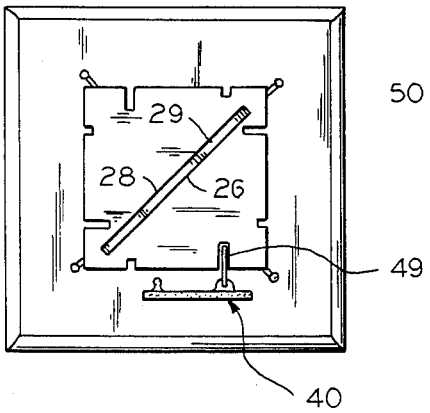
FIG. 2 is a top plan view of the display stand of the preferred embodiment of the present invention.

Base 12 is a relatively thin, rectangular base having a bottom surface 17, a parallel and spaced apart top surface 18 and edges 19. Base 12 may be decorative and should preferably be larger in cross-section than the display member 14 for providing stability to display stand 10. As shown in FIG. 3, a cylindrical dowel 20 is vertically secured to the center of top surface 18 for coupling base 12 to display member 14.

Display member 14 is an elongate piece having a generally square horizontal cross-section. Member 14 also includes a pair of cylindrical holes 23 in the center of each end, the bottom one of which (not shown) is adapted to engage dowel 20 of base 12 to couple these components. It will also be appreciated that the dowel coupling just referred to permits rotational movement of the display member 12 relative to base 12.

The information panel 16 is an optional component of the present invention and is a generally rectangular plate having front and back surfaces 26 and 28 and relatively thin edges 29. The bottom of panel 16 is adapted to be received in a slot in the top of display member 14 to couple these two components.

Before proceeding to a description of the attachment mechanism employed in display stand 10, it is appropriate at this stage of the specification to describe some of the different ways the invention may be embodied. Besides the variety of material which may be selected for construction of display stand 10, a variety of shapes and sizes may be used. For example, display stand 10 may be adapted for countertop display, in which case the display member may be from about 6 inches to several feet in length. Display stand 10 may also be employed as a floor display, and in this case, display member 10 could be several feet in length up to 6 feet or more in length. The rotational feature of the illustrated embodiment is optional and display member 14 can be secured to its base.

Furthermore, the information panel can be eliminated entirely or can be configured in any desired shape and may be attached using a dowel and hole coupling technique instead of the depicted slot arrangement. When employed, it can contain pricing information, trademarks or descriptive information concerning the article to be displayed.

As still further examples of the applicability of the present invention, it will be understood that display stand 10 can have any number of display surfaces and can be rectangular, circular, triangular in cross-section or can include five, six, seven or more vertical surfaces as desired. It should furthermore be appreciated that only a single planar display surface could be provided if the display is configured as a wall plaque and that the display surface may include ornamentation, framing, trim, etc.

Figure 4:
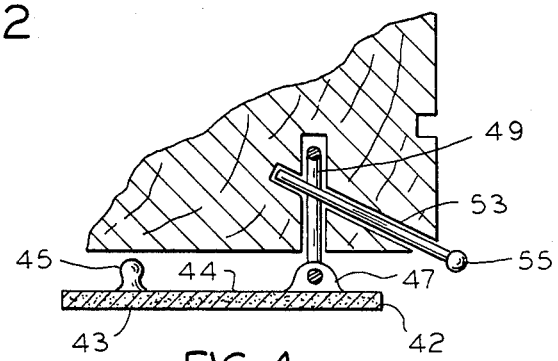
FIG. 4 is a cross-section view taken along the line 4—4 of FIG. 1 of the display stand according to the preferred embodiment of the present invention.

Proceeding now to the attachment system used in the present invention, it will be illustrated by reference to the attachment of belt buckles 40. Buckles 40, as shown in FIGS. 3 and 4, include a buckle plate 42 having a front surface 43 and a back surface 44. On the back surface, a pin 45 is provided for engaging the holes of a belt and a casting 47 is provided for attachment of a wire-form belt buckle clip 49. Clip 49 is shown to be generally C-shaped and includes a pair of points which are typically inserted in the casting 47 so that clip 49 is free to rotate around the axis of the points. The buckle may be variously embodied and does not, in and of itself, form part of the present invention. Accordingly, further details of the buckle will not be provided other than to point out that the front surface 43 typically contains decorative features and the back surface may include such features.

Referring again to display stand 10, display member 14 includes an elongate slot 50 extending from its top to its bottom and on each of its four faces. Slots 50 are sized so that they may receive the attachment clips of buckles 40. Furthermore, slots 50 are located near the corners of display member 14 for a reason which will be explained shortly. Display member 14 also includes another set of slots 52, parallel to and spaced apart from slots 50. They are primarily decorative in the illustrated embodiment, but may be used in the same manner as slots 50 if two rows of articles are to be displayed on each surface of display member 14. Furthermore, they may be used to receive pins 45 of the buckles 40 if they are long enough to enter the slots when the faces of the buckles 40 are parallel to the surface of display member 40.

Display stand 10 also includes a plurality of holes 53 which are drilled into display member 14. In the illustrated embodiment, holes 53 are drilled in the vertical corners and proceed inwardly into display member 14 in such a way that they intersect slots 50 intermediate the length thereof. Holes 53 extend inwardly beyond slots 50 by at least a small distance. The number of such holes will depend on the number of articles to be displayed on display stand 10. In the illustrated embodiment, twelve such holes are provided, three on each vertical corner, because the illustrated stand is designed for the display of twelve buckles. Obviously, the number of holes may be widely varied depending on the size of the display and the size of the displayed articles. Furthermore, the holes do not need to be drilled in the corners, but may be started adjacent slots 50, the angle of entry being corresponding adjusted to maintain the slot intersection feature.

Finally, display stand 10 includes a plurality of pins 55, one for each hole 53. Pins 55 may be nails, tacks, pins and are long enough to be inserted in holes 53. Preferably they stick out slightly from the display member 14.

The operation of display stand 10 will now be described with reference again to belt buckles 40. To attach a buckle 40, the pin 55 is removed and the buckle is held up to display member 14 so that the attachment wire-form clip 49 is intermediate the entrance and exit of hole 53. The pin 55 is inserted and passes through the clip to hold the buckle 40 in place.

It will be apparent from the foregoing description that the display stand of the present invention provides an attractive, easy to use and functional display for articles. Belt buckles, for example, may be examined thereon, with the front surface readily viewable by the customer and with the back surface viewable simply by rotating the buckle around the axis of the clip 49. Furthermore, it will be apparent that buckles 40 can only be removed after pins 55 are removed, a maneuver which takes two hands and which makes display stand 10 a deterent to shoplifters.

While the present invention has been described by reference to a single preferred embodiment, it is not to be limited thereby, but is to be limited solely by the claims which follow:

I claim:

1. A display comprising a display surface having an elongate slot therein, at least one hole in said display surface and extending inwardly from a location generally adjacent said slot, said hole intersecting said slot at an acute angle and extending there beyond, said display further comprising pin means for being selectively inserted and removed from said hole and being of sufficient length to extend outwardly from said display surface when said pin means is inserted into said hole and through said slot.

2. The invention set forth in claim 1 wherein said display includes a plurality of said slots, at least one of said holes and pin means provided for each of said slots.

3. A display stand comprising a display member having at least one vertical display surface, said display member further including at least one slot therein, at least one hole in said display surface and extending inwardly from a location generally adjacent said slot which intersects said slot at an acute angle and extends therethrough, and pin means received within said holes and extending through said slot, said pin means being of sufficient length to extend outwardly from said display surface when said pin means is inserted into said hole and through said slot.

4. The invention set forth in claim 3 wherein said display member includes a plurality of display surfaces.

5. The invention set forth in claim 4 wherein each of said display surfaces is planar and includes at least one slot.

6. The invention set forth in claim 5 wherein said display stand further includes a base for said display member.

7. The invention set forth in claim 6 wherein said display member is rotatably mounted to said base.

8. The invention set forth in claim 5 wherein said display stand further includes an information display panel secured thereto.

9. A display for articles which includes a base, an elongate display member rotatably mounted to said base, said display member having a top and bottom and including a plurality of planar, vertical display surfaces, each of said display surfaces including at least one vertical slot extending substantially from the top to the bottom of said display member, a plurality of spaced apart holes adjacent each of said slots, said holes being angled inwardly into said display member and intersecting said slots at an acute angle, and pin means received in said holes and being of sufficient length to extend outwardly from said display surface when said pin means are inserted into said holes and through said slots.

10. The invention set forth in claim 9 wherein said display member includes four display surfaces.

11. In combination, at lesat one article to be displayed and a display therefore, said article including a component to be attached to said display and having an opening therethrough, said display including a display surface having a slot therein, said slot having sidewalls and a bottom and being sufficiently wide to receive said component and said opening being located between said sidewalls, a hole in said display extending inwardly from said display surface from a location adjacent said slot and intersecting the side walls of said slot at an acute angle, pin means received in said hole and extending through said sidewalls and the opening of said article, said pin means being of sufficient length to extend outwardly from said display surface when said pin means is inserted into said hole and through said slot.

12. The invention set forth in claim 11 wherein said display includes a plurality of said holes and pin means.

13. The invention set forth in claim 12 wherein said display includes a plurality of said slots, holes and pin means.

14. The invention set forth in claim 11 wherein said display includes a plurality of display surface, each of said display surfaces including at least one slot and a plurality of holes and pin means for each slot.

15. The invention set forth in either of claims 11, 12, 13 or 14 wherein said article is a belt buckle and said component is a wire-form ring rotatably secured to said belt buckle and having an opening therein.

* * * * *